US011420837B2

(12) United States Patent
Nakamura

(10) Patent No.: US 11,420,837 B2
(45) Date of Patent: Aug. 23, 2022

(54) SHEET PLACEMENT DEVICE, SHEET FEEDING DEVICE, AND IMAGE FORMING APPARATUS

(71) Applicant: Ricoh Company, Ltd., Tokyo (JP)

(72) Inventor: Kazune Nakamura, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/094,862

(22) Filed: Nov. 11, 2020

(65) Prior Publication Data

US 2021/0163244 A1 Jun. 3, 2021

(30) Foreign Application Priority Data

Nov. 29, 2019 (JP) ..... JP2019-216856

(51) Int. Cl.

| | |
|---|---|
| ***B65H 1/26*** | (2006.01) |
| ***B65H 1/04*** | (2006.01) |
| ***B65H 7/06*** | (2006.01) |
| ***B65H 43/04*** | (2006.01) |
| ***B65H 9/00*** | (2006.01) |

(52) U.S. Cl.

CPC ..... *B65H 7/06* (2013.01); *B65H 9/004* (2013.01); *B65H 43/04* (2013.01); *B65H 2553/23* (2013.01)

(58) Field of Classification Search

CPC . B65H 1/04; B65H 1/266; B65H 7/06; B65H 7/02; B65H 7/04; B65H 7/10; B65H 9/004; B65H 2511/12; B65H 2511/10; B65H 2511/11; B65H 2553/23; B65H 2404/11425; B65H 43/04

See application file for complete search history.

(56) References Cited

U.S. PATENT DOCUMENTS

| | | | | |
|---|---|---|---|---|
| 8,820,734 | B2 * | 9/2014 | Miyakawa | B65H 7/02 271/171 |
| 8,894,063 | B2 * | 11/2014 | Araaki | B65H 7/02 271/171 |
| 9,126,787 | B2 * | 9/2015 | Adachi | B65H 9/101 |
| 2020/0270089 | A1 | 8/2020 | Yamaji et al. | |

FOREIGN PATENT DOCUMENTS

| | | | |
|---|---|---|---|
| JP | 2007-145486 | | 6/2007 |
| JP | 2012030939 A | * | 2/2012 |

* cited by examiner

*Primary Examiner* — Luis A Gonzalez
(74) *Attorney, Agent, or Firm* — Xsensus LLP

(57) ABSTRACT

A sheet placement device includes a placement member on which a sheet is placed; a limiter that is movable with respect to the placement member to limit a position of an end of the sheet placed on the placement member; a contact member provided in the limiter and to be displaced by contacting with the end of the sheet; and a detector that detects displacement of the contact member. The detector is provided in the placement member.

11 Claims, 7 Drawing Sheets

SHEET PLACEMENT DEVICE, SHEET FEEDING DEVICE, AND IMAGE FORMING APPARATUS

CROSS-REFERENCE TO RELATED APPLICATIONS

The present application claims priority under 35 U.S.C. § 119 to Japanese Patent Application No. 2019-216856, filed on Nov. 29, 2019. The contents of which are incorporated herein by reference in their entirety.

BACKGROUND OF THE INVENTION

1. Field of the Invention

The present invention relates to a sheet placement device, a sheet feeding device, and an image forming apparatus.

2. Description of the Related Art

Conventionally, sheet placement devices for use in an image forming apparatus, such as a copier or a printer, have been known, on which sheets such as paper or overhead projector (OHP) films are placed.

For example, such a sheet placement device may include, as a movable element, side fences (side limiter) that restrict the positions of lateral ends of a sheet. The side fences may be equipped with a sensor serving to detect contact between the sheet and the side fences (disclosed in Japanese Unexamined Patent Application Publication No. 2007-145486, for instance).

Along with the movement of the movable element as the side fences including the sensor, wiring connected to the sensor also moves or shifts. As a result, the wiring connected to the sensor or the connection therebetween may be applied with a load, resulting in a contact failure.

SUMMARY OF THE INVENTION

According to one aspect of the present invention, a sheet placement device includes a placement member on which a sheet is placed; a limiter that is movable with respect to the placement member to limit a position of an end of the sheet placed on the placement member; a contact member provided in the limiter and to be displaced by contacting with the end of the sheet; and a detector that detects displacement of the contact member. The detector is provided in the placement member.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
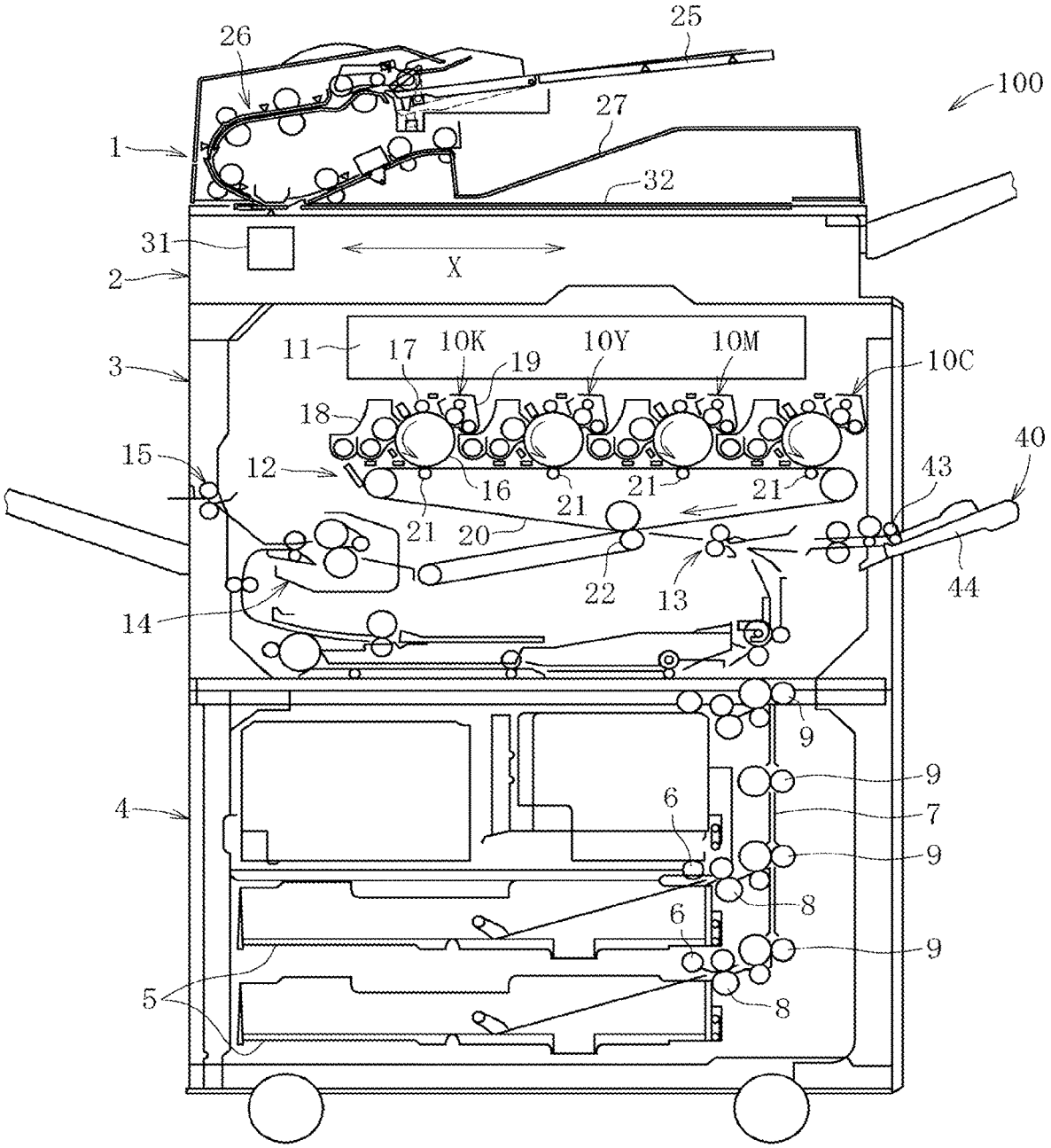
FIG. 1 is a schematic diagram of an exemplary structure of an image forming apparatus according to one embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

In the respective drawings, constitutional elements including members, parts, or components having the same functions or the same shape will be denoted by the same reference numerals as long as they are identifiable, and an overlapping description thereof will be omitted.

FIG. 1 is a schematic diagram of a configuration of an image forming apparatus according to one embodiment.

As illustrated in FIG. 1, an image forming apparatus 100 according to the present embodiment includes a document feeding device 1, an image reading device 2, an image forming unit 3, a paper feeding unit 4, and a manual sheet feeding unit 40. In the present embodiment, the image forming apparatus is exemplified by an electrophotographic color laser printer, however, it may be of another image forming system such as inkjet. Further, the image forming apparatus of the present embodiment may be a monochrome image forming apparatus or may be a copier, a facsimile machine, or a multifunction peripheral (MFP) including two or three of a printing function, a copying function, and a facsimile function.

The document feeding device 1 includes a document tray 25 on which documents are placed, a document feeder 26 that separates and feeds the documents one by one from the document tray 25 to a contact glass 32 of the image reading device 2, and a discharge tray 27 onto which the documents are discharged after image reading by the image reading device 2.

The image reading device 2 includes an optical scanning unit 31 as an image reader serving to read an image from a document. The optical scanning unit 31 includes a light source that irradiates the document on the contact glass 32 with light, a charge coupled device (CCD) serving as an image reader that reads an image from reflected light by the document. The optical scanning unit 31 may include another image sensor, such as a contact image sensor (CIS), in place of the CCD.

The image reading device 2 is configured to be switchable between a fed document reading mode and a placed document reading mode. In the fed document reading mode, the image reading device 2 reads an image of a document, fed by the document feeding device 1, on the contact glass 32 of the image reading device 2. In the placed document reading mode, the image reading device 2 reads an image of a stationary document set on the contact glass 32.

In the fed document reading mode, the optical scanning unit 31 is set at a given reading position as illustrated in FIG. 1, to read the image of a document passing through the reading position, fed by the document feeding device 1. In the placed document reading mode, a document is placed on the contact glass 32, and the optical scanning unit 31 reciprocates in a sub-scanning direction X, as illustrated in FIG. 1, to read the image of the document on the contact glass 32.

As illustrated in FIG. 1, the paper feeding unit 4 includes a plurality of paper cassettes 5. The paper cassettes 5 store sheets of paper as a recording medium. The paper feeding unit 4 further includes feed rollers 6 that feed sheets of paper from the respective paper cassettes 5, separation rollers 8 that separate and supply the fed sheets of paper one by one to a paper feed path 7, and conveyance rollers 9 that convey the sheets of paper in the paper feed path 7.

As illustrated in FIG. 1, the image forming unit 3 includes four image formation units 10K, 10Y, 10M, and 10C, an optical writing device 11, a transfer device 12, a timing roller pair 13, a fixing device 14, and a paper ejection roller pair 15.

The four image formation units 10K, 10Y, 10M, and 10C have the same configuration except for storing developer of different colors, black, yellow, magenta, and cyan corresponding to color components of a color image. Specifically, each of the image formation units 10K, 10Y, 10M, and 10C includes a photoconductor drum 16 as an image bearer, a charging device 17 that charges the surface of the photoconductor 16, a developing device 18 that supplies toner as developer to the surface of the photoconductor 16 to form a toner image, and a cleaning device 19 that cleans the surface of the photoconductor 16. FIG. 1 depicts, with reference numerals, only the photoconductor 16, the charging device 17, the developing device 18, and the cleaning device 19 of the image formation unit 10K that generates black images. Those of the image formation units 10Y, 10M, and 10C are depicted without reference numerals.

The transfer device 12 includes an endless intermediate transfer belt 20 that is extended over a plurality of rollers, four primary transfer rollers 21 that transfer toner images from the respective photoconductors 16 onto the intermediate transfer belt 20, and a secondary transfer roller 22 that transfers the toner images from the intermediate transfer belt 20 onto a sheet of paper.

The manual sheet feeding unit 40 includes a sheet feeding tray 44 as a placement member on which sheets of paper are placed and a feed roller 43 as a feeding member that feeds the sheets of paper from the sheet feeding tray 44. The sheet feeding tray 44 is attached to the apparatus body in an openable-closable or swingable manner. In the open state (as illustrated in FIG. 1) sheets of paper can be set on the sheet feeding tray 44 and fed.

Printing operation of the image forming apparatus according to the present embodiment will be described with reference to FIG. 1.

In response to a printing start instruction, in the image formation units 10K, 10Y, 10M, and 10C the photoconductors 16 are rotated, and their surfaces are uniformly charged at high potential by the charging devices 17. Subsequently, the optical writing device 11 exposes the surface of each of the photoconductors 16 on the basis of image information on the document read by the image reading device 2 or print information instructed by a terminal, to lower the potential of the exposed part and form an electrostatic latent image thereon. The developing device 18 supplies toner to the electrostatic latent image, thereby forming a toner image on each of the photoconductors 16.

Along with the rotation of the photoconductors 16, the toner images thereon reach the position of the primary transfer roller 21 (primary transfer nip) and are sequentially transferred onto the rotating intermediate transfer belt 20 in a superimposed manner. Then, along with the rotation of the intermediate transfer belt 20, the toner images are conveyed to the secondary transfer roller (secondary transfer nip), and transferred thereby onto a sheet of paper, which has been fed from the paper feeding unit 4 or the manual sheet feeding unit 40. The sheet, fed from the paper feeding unit 4 or the manual sheet feeding unit 40, is temporarily stopped by the timing roller pair 13, and conveyed at timing at which the toner images on the intermediate transfer belt 20 reach the secondary transfer nip. In this manner, a full color toner image is generated on the sheet. After transfer of the toner images, the cleaning devices 19 remove remaining toner from the corresponding photoconductors 16.

The sheet having the toner images transferred thereon is conveyed to the fixing device 14, and the toner images are fixed to the sheet by the fixing device 14. The sheet is discharged to the outside of the apparatus by the paper ejection roller pair 15, completing a series of printing operation.

Next, a configuration of the manual sheet feeding unit 40 according to the present embodiment will be described in detail.

Figure 2:
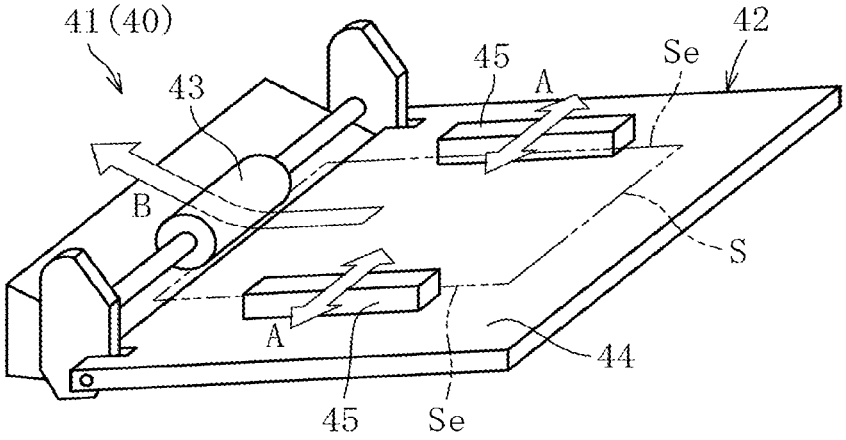
FIG. 2 is a perspective view of a sheet feeding device.

The manual sheet feeding unit 40 represents a sheet feeding device capable of supplying sheets other than sheets of paper, such as OHP sheets. As illustrated in FIG. 2, a sheet feeding device 41 or the manual sheet feeding unit 40 includes a sheet placement device 42 on which a sheet S is placed, and the feed roller 43 as a feeding member that feeds the sheet S from the sheet placement device 42.

The sheet placement device 42 includes the sheet feeding tray 44 as a placement member on which the sheet S is placed, and a pair of side fences 45 serving as a lateral limiter that limits the lateral end positions of the sheet S. Each of the side fences 45 is movably set on the sheet feeding tray 44 in a lateral direction A of the sheet S. Herein, the lateral direction refers to a direction parallel to the surface of the sheet feeding tray 44 on which the sheet S is placed, among directions crossing a feeding direction B of the sheet S. The side fences 45 are moved in the lateral direction A to contact with both lateral ends Se of the sheet S, to limit the end positions of the sheet S in the lateral direction.

Figure 3:
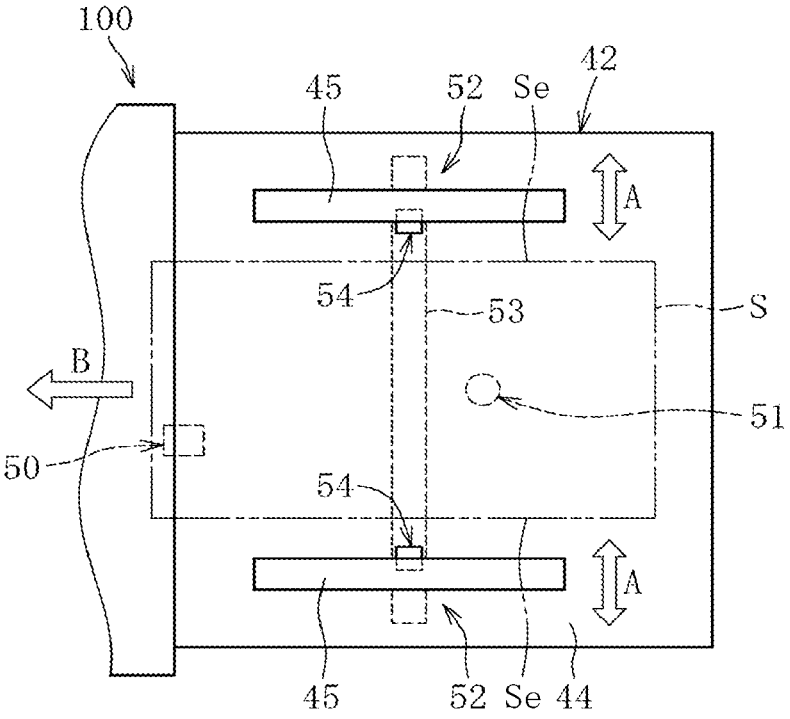
FIG. 3 is a plan view of a sheet placement device.

FIG. 3 is a plan view of the sheet placement device 42.

As illustrated in FIG. 3, the sheet placement device 42 includes a sheet detector 50, a limiter-position detector 51, and gap detectors 52.

The sheet detector 50 serves to detect presence or absence of the sheet S on the sheet feeding tray 44. The sheet detector 50 includes an oscillator member that oscillates by contacting with the sheet S when placed on the sheet feeding tray 44, a projector, and a light receiver whose optical paths are switched by the oscillator member between a light shielding state and a light transmitting state. The sheet detector 50 may be located in the vicinity of the joint between the body of the image forming apparatus and the sheet feeding tray 44, in place of in the sheet feeding tray 44.

The limiter-position detector 51 serves to detect the lateral positions of the side fences 45. Examples of the limiter-position detector 51 includes known detectors, such as an encoder or a variable resistor, which detect movement of the side fences 45 in the lateral direction. The limiter-position detector 51 detects a signal that varies with movement of the side fences 45, to thereby determine the positions of the side fences 45 in the lateral direction.

The gap detectors 52 serve to detect gaps between the side fences 45 and the sheet S. According to the present embodiment, each of the gap detectors 52 includes a link mechanism 54 that contacts and moves together with the sheet S, and a detector 53 that detects the movement of the link mechanism 54.

An exemplary structure of the gap detectors 52 will be described in detail below. The gap detectors 52 have basically the same structure except that they are bilaterally symmetric to each other at both the side fences 45. Thus, the gap detector 52 at one of the side fences 45, as illustrated in FIG. 4, will be described by way of example.

Figure 4:
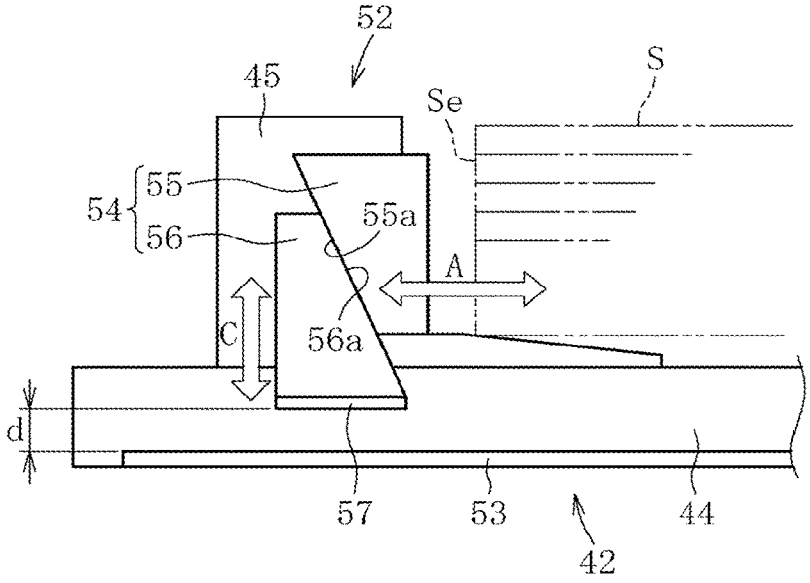
FIG. 4 is a diagram illustrating a configuration of a gap detector.

As illustrated in FIG. 4, the link mechanism 54 includes a contact member 55 and a link member 56. The contact member 55 can contact with the lateral end Se of the sheet S or a bundle of sheets placed on the sheet feeding tray 44. Specifically, the contact member 55 is set such that the contact member 55 can protrude inward in the lateral direction A from the side fence 45 so as to come into contact with the lateral end Se of the sheet S. In other words, the contact member 55 is displaceable in a protruding direction (the lateral direction A) and a pressed direction (opposite to the lateral direction A) with respect to the side fence 45. Further, the contact member 55 is biased from the side fence 45 in the protruding direction by a biasing member such as a spring. Thus, in no contact with the sheet S, the contact member 55 is maintained in an inwardly protruding state in the lateral direction with respect to the side fence 45.

The link member 56 is displaced along with the displacement of the contact member 55. Specifically, the link member 56 is displaceable with respect to the side fence 45 in a direction C (a vertical direction in FIG. 4) intersecting with or perpendicular to the lateral direction A. The link member 56 and the contact member 55 include inclined surfaces 56*a* and 55*a* with respect to the displacement directions, respectively. The inclined surfaces 56*a* and 55*a* of the link member 56 and the contact member 55 contact with each other, therefore, when one of the link member 56 and the contact member 55 is displaced, the other is pressed and displaced by the one member in the direction intersecting with or perpendicular to the displacement direction of the one member.

Further, the contact member 55 and the link member 56 are attached to the side fence 45. Thus, the contact member 55 and the link member 56 move in the lateral direction A together with the side fence 45.

The detector 53 serves as a sensor that senses displacement of the link member 56 and displacement of the contact member 55 linked to the link member 56. The detector 53 continuously extends in the lateral direction A inside the sheet feeding tray 44 (see FIG. 3). In the present embodiment, the detector 53 is exemplified by a capacitance sensor. Meanwhile, the link member 56 includes a conductor 57 to be detected by the detector 53 and function as a detection member. While the conductor 57 approaches or moves away from the detector 53 along with the displacement of the link member 56, the output of the detector 53 varies in accordance with a distance (d) between the conductor 57 and the detector 53. Thereby, the detector 53 detects the displacement of the link member 56 and the displacement of the contact member 55.

Figure 5:
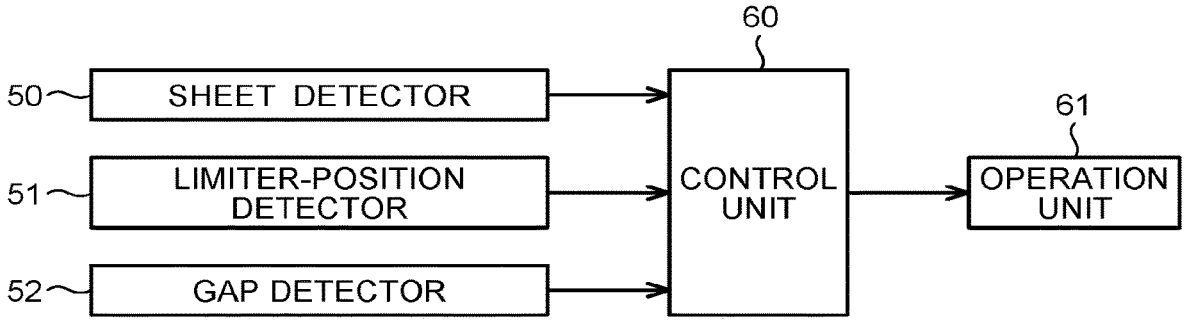
FIG. 5 is a block diagram illustrating a part of a control system of the image forming apparatus.

FIG. 5 is a block diagram illustrating part of a control system of the image forming apparatus of the present embodiment.

As illustrated in FIG. 5, the sheet detector 50, the limiter-position detector 51, and the gap detector 52 each transmit a detection signal (output signal) to a control unit 60 of the image forming apparatus. The control unit 60 represents a central processing unit (CPU) that controls various functions of the image forming apparatus including an operation unit 61, such as an operation panel. The operation unit 61 includes an input element to which the user inputs information, and a display that provides information to the user.

Figure 6:
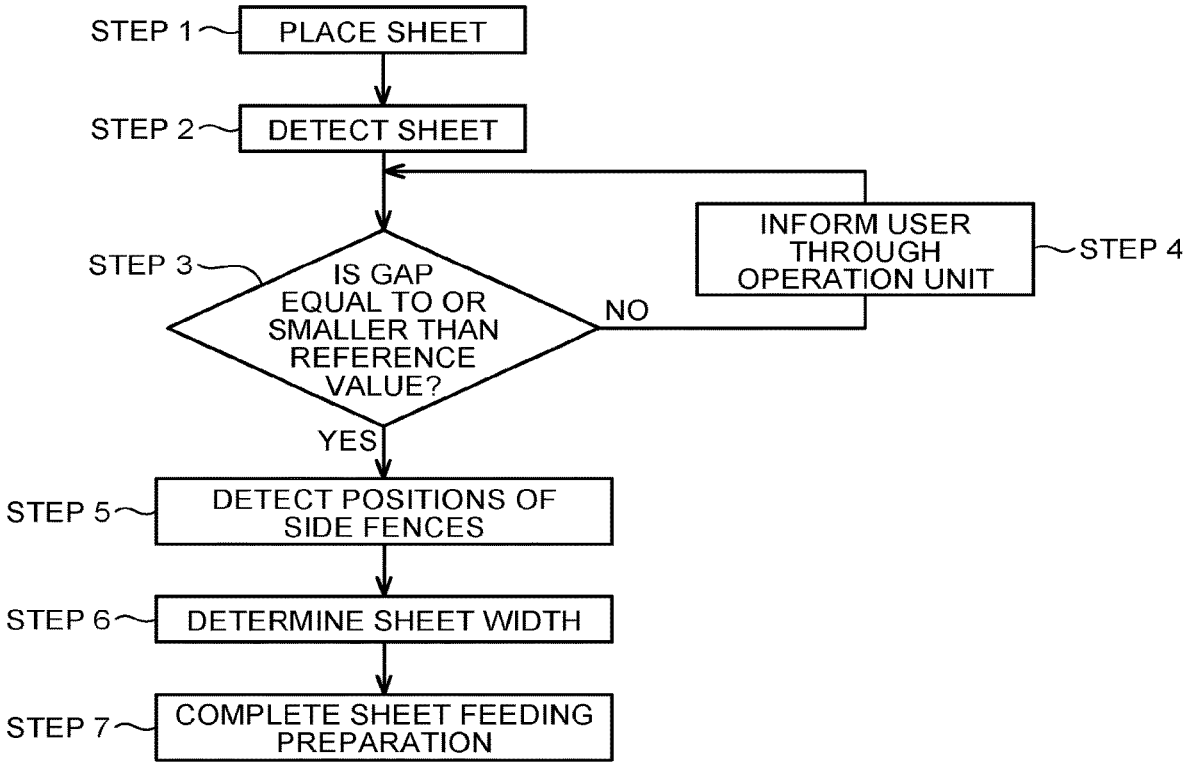
FIG. 6 is a flowchart illustrating an operation of the control system from placement of a sheet on a sheet feeding tray to completion of a paper feeding preparation.
Figure 7:
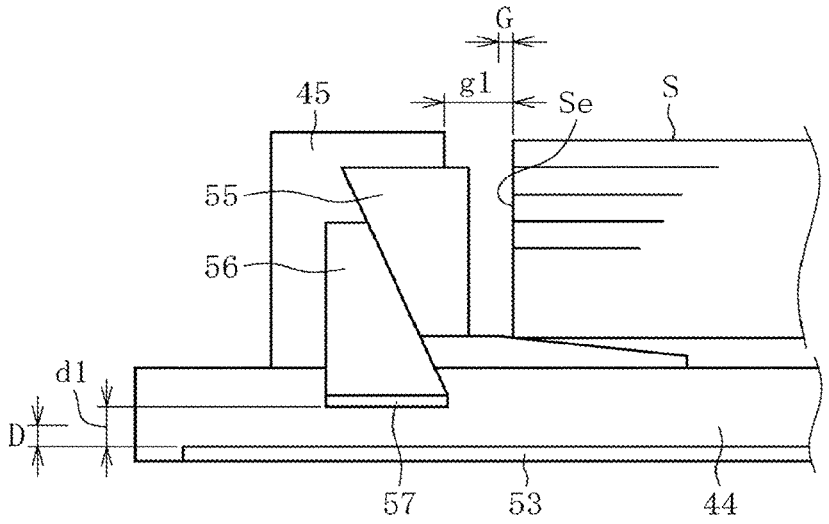
FIG. 7 is a diagram illustrating a side fence greatly apart from a lateral end of a sheet.
Figure 8:
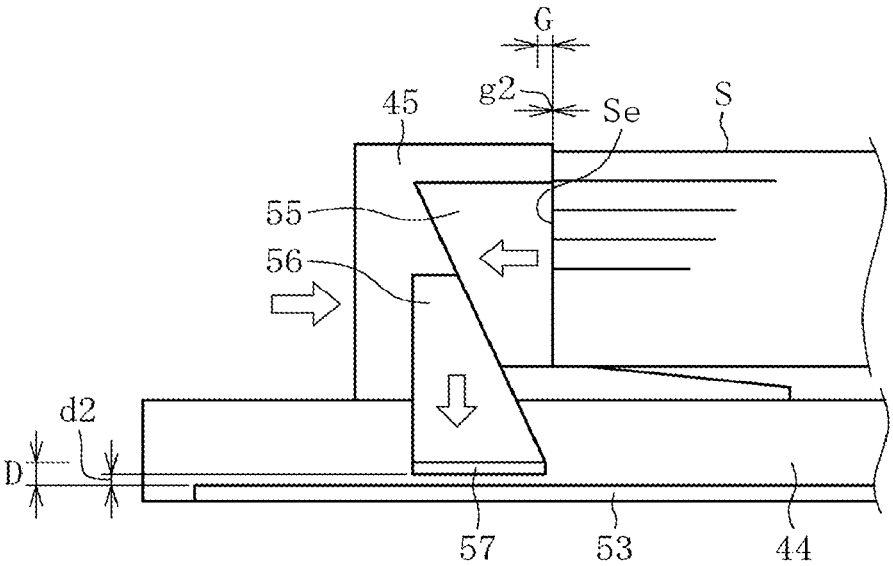
FIG. 8 is a diagram illustrating the side fence in contact with or adjacent to the lateral end of the sheet.

The following will describe an operation of the control system from placement of the sheet S on the sheet feeding tray 44 to completion of a paper feeding preparation, with reference to FIG. 6 to FIG. 8.

The sheet detector 50 detects the sheet S (STEP 2 in FIG. 6) when placed on the sheet feeding tray 44 (STEP 1 in FIG. 6). The sheet detector 50 then transmits a detection signal to the control unit 60, and the control unit 60 thereby determines presence of the sheet.

After the control unit 60 determines presence of the sheet, the gap detector 52 detects a gap between the side fence 45 and the sheet S. As illustrated in FIG. 7, if the side fence 45 is greatly apart from the lateral end Se of the sheet S by a given reference value G or more (NO at STEP 3 in FIG. 6), the control unit 60 instructs the operation unit 61 (operation panel) to display the situation and inform the user of the necessity to move the side fence 45 closer to the sheet S (STEP 4 in FIG. 6). The control unit 60 determines from detected information from the gap detector 52 whether a gap g1 between the side fence 45 and the lateral end Se of the sheet S is equal to or smaller than the reference value G. In other words, the control unit 60 determines a length of the gap g1 from an output signal, of the detector 53, which varies with a distance between the detector 53 and the conductor 57 included in the link member 56. In FIG. 7, the distance d1 between the conductor 57 and the detector 53 is more than a given reference value D, thus, the control unit 60 determines that the gap g1 between the side fence 45 and the lateral end Se of the sheet S is larger than the reference value G.

Thereafter, as illustrated in FIG. 8, the user moves the side fences 45 closer to the lateral end Se of the sheet S to decrease a gap g2 between the side fence 45 and the sheet S to the reference value G or less (YES at STEP 3 in FIG. 6). The control unit 60 then proceeds to a next process. Specifically, along with the motion of the side fence 45 to the lateral end Se of the sheet S, the contact member 55 comes into contact with the lateral end Se of the sheet S and is pressed to the side fence 45. The link member 56 becomes displaced toward the detector 53 along with the displacement of the contact member 55, thus, the conductor 57 approaches the detector 53. As a result, a distance d2 between the conductor 57 and the detector 53 decreases to the given reference value D or less, and the control unit 60 determines that the gap g2 between the side fence 45 and the sheet S is equal to or smaller than the reference value G. The reference value G for the gap may be set to zero or a given value or less (i.e., no gap or a slight gap between the side fence 45 and the lateral end Se of the sheet S).

In the next process, the limiter-position detector 51 detects positions of the side fences 45 in the lateral direction A (STEP 5 in FIG. 6). The control unit 60 determines a width of the sheet S from detected positional information on the side fences 45 (STEP 6 in FIG. 6). That is, as described above, the side fences 45 are set close to or in contact with the lateral ends Se of the sheet S, thus, the interval therebetween is set to a certain value corresponding to the width of the sheet S. Thereby, the control unit 60 can determine the width of the sheet S by calculating the value of the interval from the positional information of the side fence pair 45. In particular, with the reference value G for the gaps between the side fences 45 and the sheet S set to zero (no gap), the control unit 60 can accurately determine the width of the sheet S. In this manner, the control unit 60 determines the width of the sheet S, completing a preparation for feeding a sheet from the sheet feeding tray 44 (STEP 7 in FIG. 6).

In the present embodiment the sheet placement device 42 configured as above includes the side fences 45 provided with the contact members 55 and the link members 56. Because of this, the contact members 55 and the link members 56 move together with the side fences 45 in the lateral direction A. Meanwhile, the detector 53 is provided in the sheet feeding tray 44, therefore, the detector 53 and the wiring for connecting the detector 53 and the control unit 60 do not move as the side fences 45 move. In other words, in the present embodiment, the detector 53 and the wiring connected to the detector 53 are not located in the movable side fences 45. Hence, the wiring and the connection therebetween can be avoided from receiving a load due to the movement of the side fences 45. This leads to preventing the wiring and the connection from being damaged or worn out. According to the features of the present embodiment, thus, the wiring connected to the detector 53 and the connection therebetween are less likely to be damaged, and they can be improved in durability and reliability.

Another embodiment of the present invention will be described. The following will mainly describe differences from the above embodiment, and an overlapping description of the rest will be omitted.

Figure 9:
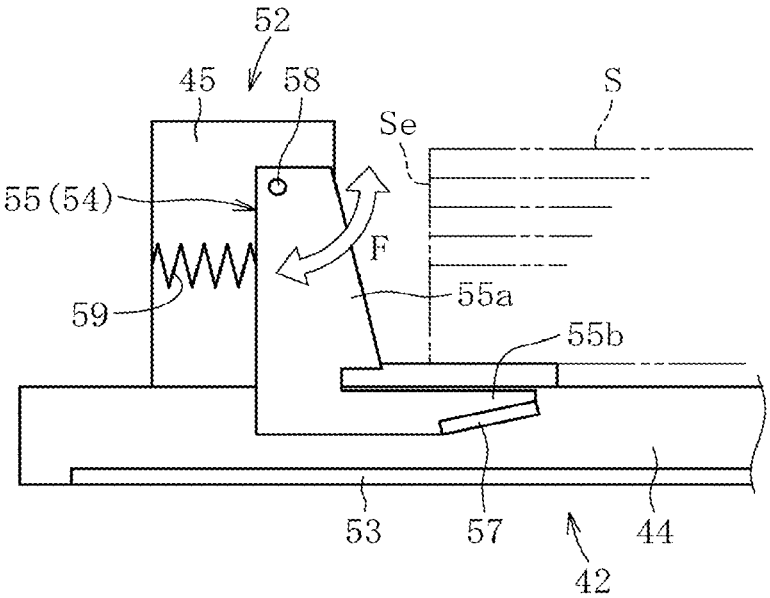
FIG. 9 is a diagram illustrating a configuration of a sheet placement device according to another embodiment.

A sheet placement device 42 illustrated in FIG. 9 is different from that in the above embodiment in the structure of the link mechanism 54 that contacts the sheet S and moves together with the sheet. Specifically, the side fence 45 is provided with a pivot 58 and the contact member 55 is swingable or rotatable around the pivot 58 in the directions indicated by the arrow F in FIG. 9. Further, the contact member 55 includes the conductor 57 to be detected. That is, in the present embodiment, the sheet placement device 42 includes no link member 56 that holds the conductor 57. In the present embodiment, the contact member 55 includes an inclined surface 55*a* that is to contact with the lateral end Se of the sheet S and a detection-member holder 55*b* that holds the conductor 57.

The side fence 45 further includes a spring 59 serving as a biasing member that biases the contact member 55. Biased by the spring 59, the inclined surface 55*a* of the contact member 55 is held in an inwardly protruding state from the side fence 45 in the lateral direction without contacting with the sheet S.

Figure 10:
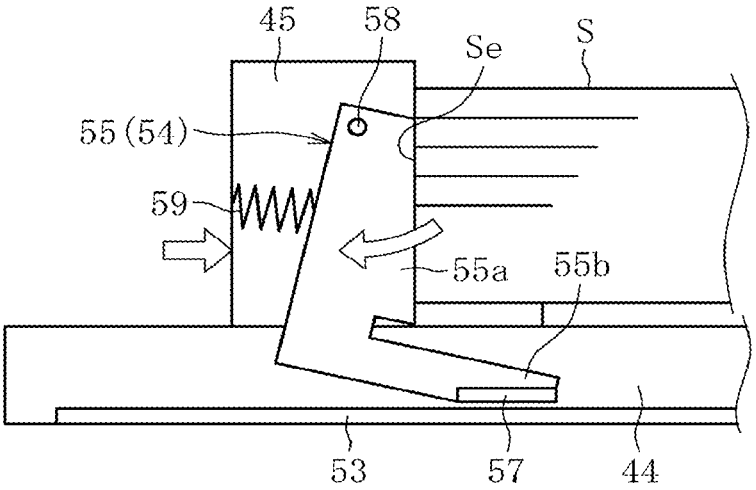
FIG. 10 is a diagram illustrating an operation according to another embodiment.

As illustrated in FIG. 10, as the side fence 45 approaches the sheet S on the sheet feeding tray 44, the inclined surface 55*a* of the contact member 55 comes into contact with the lateral end Se of the sheet S, and swings and is pressed onto the side fence 45. At this time, the conductor 57 approaches the detector 53, varying the output of the detector 53. In this manner, in the present embodiment, the detector 53 detects displacement of the contact member 55 from variation in the output of the detector 53, which occurs in accordance with the swing of the contact member 55. The detector 53 detects a gap between the side fence 45 and the sheet S from an amount of the displacement of the contact member 55 (variation in output of the detector 53).

In the present embodiment, the detector 53 is provided in the sheet feeding tray 44. Thus, the detector 53 and the wiring connected to the detector 53 do not move as the side fences 45 moves. As in the above embodiment, the wiring and the connection therebetween can be thus prevented from being damaged or worn out, and improved in durability.

Figure 11:
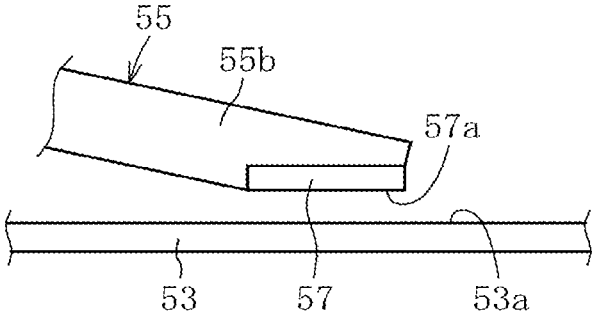
FIG. 11 is a diagram illustrating a conductor located closest to a detector with their opposing surfaces in parallel to each other.

In the configuration as illustrated in FIG. 9, as the contact member 55 swings, the opposing surface of the conductor 57 relative to the detector 53 changes in orientation. In such a case, inclination of the opposing surfaces of the conductor 57 and the detector 53 relative to each other may cause the output of the detector 53 to become unstable. For this reason, as illustrated in FIG. 11, it is preferable that the conductor 57 and the detector 53 be set closest to each other with their opposing surfaces 57*a* and 53*a* parallel to each other. This arrangement enables the output of the detector 53 to be stable and the detector 53 to accurately detect a gap between the side fence 45 and the sheet S.

Figure 12:
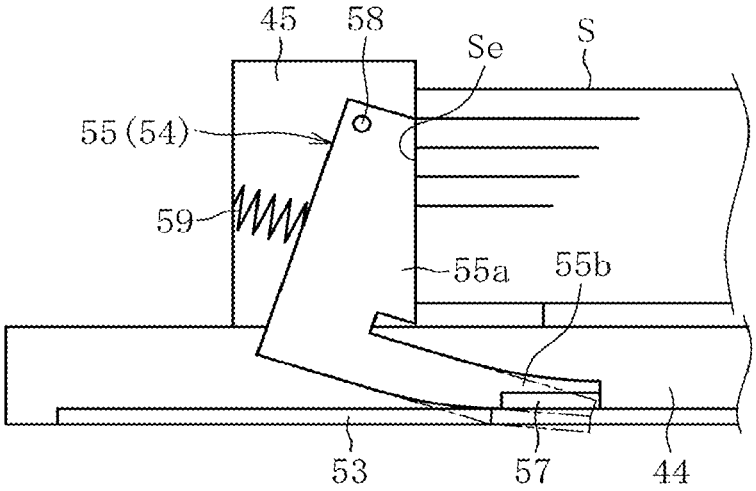
FIG. 12 is a diagram illustrating an example of a contact member made of an elastic material.

In the above embodiments, the detector 53 serves as a capacitance sensor to be able to detect a gap while in no contact with the detection member (conductor 57). However, the detector 53 and the conductor 57 may not be constantly in no contact with each other. The conductor 57 may approach and contact with the detector 53 as illustrated in FIG. 12 by way of example. In addition, the contact member 55 may be made of an elastic material (elastic member) to elastically deform by contact between the detector 53 and the conductor 57. In this case, with the gap between the side fence 45 and the sheet S decreasing to the reference value G or less (or with no gap), the conductor 57 contacts with and is pressed against the detector 53, and the contact member 55 is elastically deformed from a state indicated by the chain double-dashed line to a state indicated by the solid line in FIG. 12. Thereby, the conductor 57 can be in tight contact with the detector 53. This can further stabilize the output of the detector 53 and allows the detector 53 to more accurately detect the gap between the side fence 45 and the sheet S matching the reference value G or less.

Figure 13:
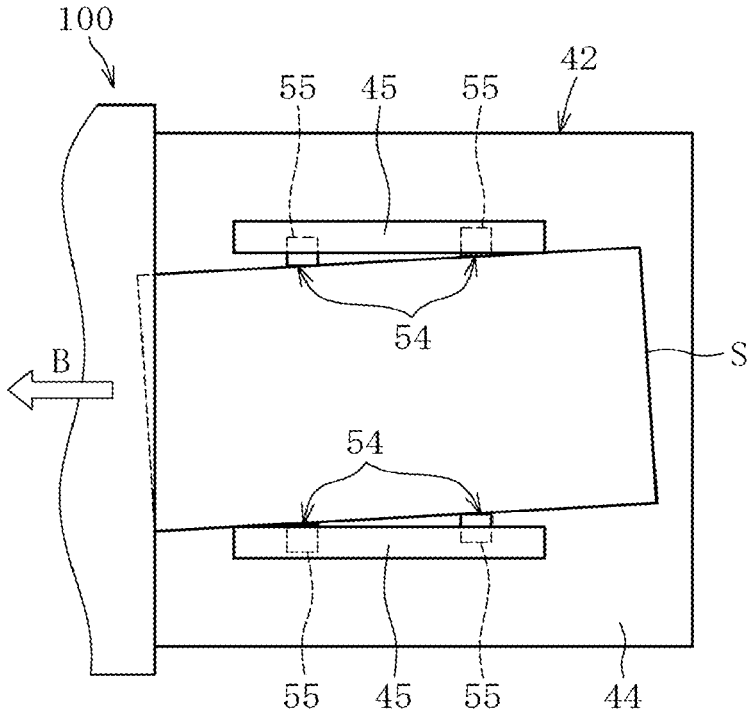
FIG. 13 is a diagram illustrating an example of a side fence provided with a plurality of contact members.

As illustrated in an example in FIG. 13, the side fences 45 may each include a plurality of contact members 55. In this example, the contact members 55 are aligned in a feeding direction B. The contact members 55 aligned in the feeding direction B enables determination as to whether the sheet S is inclined with respect to the feeding direction B. That is, if the sheet S is placed on the sheet feeding tray 44 in an inclined posture with respect to the feeding direction B, as illustrated in FIG. 13, with the side fences 45 brought close to or in contact with the sheet S, the contact members 55 contacting the sheet S are pressed to the side fences 45 by different amounts (amounts of displacement). By the detector 53's detecting the amount of displacement of each of the contact members 55 in the same manner as described above, it is possible to determine an inclined posture of the sheet S placed. The number of the contact members 55 provided in each of the side fences 45 is not limited to two and may be three or more.

The configurations, actions, and effects of the embodiments according to the present invention have been described above. However, the present invention is not limited to the above embodiments, and various modifications may be made without departing from the scope of the present invention.

For example, the detector 53 may be another sensor, such as an optical sensor or a pressure-sensitive sensor, instead of the capacitance sensor. Furthermore, the present invention is applicable not only to the placement structure for the detector 53 that detects gaps between the side fences 45 and the sheet S but also to a placement structure for a detector that detects a gap between the sheet and an end fence serving as a rear-end limiter that limits the rear-end position of the sheet S. Moreover, the present invention is applicable to a paper tray that is containable in and extractable from the body of the image forming apparatus, or a document tray on which a document is placed, in addition to the sheet feeding tray attached in an openable-closable manner to the body of the image forming apparatus. Furthermore, the application of the present invention is not limited to a sheet placement device and a sheet feeding device to be incorporated in an image forming apparatus. The present invention is also applicable to a sheet placement device and a sheet feeding device to be incorporated in other apparatuses than the image forming apparatus.

According to the present invention, it is made possible to prevent a load from being applied to wiring connected to a detector and a connection between the wiring and the detector.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is thus to be understood that within the scope of the appended claims, the disclosure of the present invention may be practiced otherwise than as specifically described herein.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A sheet placement device comprising:

a placement member on which a sheet is placed;

a limiter that is movable with respect to the placement member and limits a position of an end of the sheet placed on the placement member;

a contacter provided in the limiter and to be displaced by contacting with the end of the sheet; and a detector that detects displacement of the contacter, wherein the detector is provided at the placement member and remains static when the limiter moves.

2. The sheet placement device according to claim 1, further comprising:

a conductor that is to be displaced along with displacement of the contacter, wherein the detector includes a capacitance sensor that senses capacitance that varies in accordance with a distance to the conductor.

3. The sheet placement device according to claim 2, wherein the conductor is located closest to the capacitance sensor with opposing surfaces of the conductor and the capacitance sensor parallel to each other.

4. The sheet placement device according to claim 2, wherein the conductor comes into contact with the capacitance sensor along with the displacement of the contacter.

5. The sheet placement device according to claim 4, wherein the conductor is provided in the contacter, the contacter is made of an elastic member, and the elastic member is elastically deformed when the conductor contacts with the capacitance sensor.

6. The sheet placement device according to claim 1, further comprising:

a limiter-position detector that detects a position of the limiter.

7. The sheet placement device according to claim 1, wherein

The contacter includes a plurality of contacters, and the contacters are provided in the limiter.

8. The sheet placement device according to claim 1, wherein the limiter limits a position of a lateral end of the sheet.

9. A sheet feeding device comprising:

the sheet placement device according to claim 1 on which a sheet is placed;

a feeding unit that feeds the sheet placed on the sheet placement device.

10. An image forming apparatus comprising:

an image forming unit that forms an image on a sheet; and the sheet feeding device according to claim 9 that feeds the sheet to the image forming unit.

11. A sheet placement device comprising:

a placement member on which a sheet is placed;

a limiter that is movable with respect to the placement member and limits a position of an end of the sheet placed on the placement member;

a contacter provided in the limiter and to be displaced by contacting with the end of the sheet;

a detector that detects displacement of the contacter; and a conductor that is to be displaced along with displacement of the contacter, wherein the detector is provided at the placement member and remains static when the limiter moves, and the detector includes a capacitance sensor that senses capacitance that varies in accordance with a distance to the conductor.

* * * * *